US006584824B1

(12) United States Patent
Peterson et al.

(10) Patent No.: US 6,584,824 B1
(45) Date of Patent: Jul. 1, 2003

(54) APPARATUS FOR PRODUCING A VEHICLE WHEEL RIM

(75) Inventors: Gary L. Peterson, Sedalia, MO (US); Garth Lawrence, Oscoda, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 3 days.

(21) Appl. No.: 09/933,253

(22) Filed: Aug. 20, 2001

(51) Int. Cl.[7] ..... B21D 39/20
(52) U.S. Cl. ..... 72/393
(58) Field of Search ..... 72/393

(56) References Cited

U.S. PATENT DOCUMENTS 1,067,115 A * 7/1913 Hufford ..... 72/393
3,344,634 A * 10/1967 Ellenburg ..... 72/393
5,010,759 A * 4/1991 Yokomizo et al. ..... 72/393

* cited by examiner

*Primary Examiner*—Lowell A. Larson
(74) *Attorney, Agent, or Firm*—MacMillan, Sobanski & Todd, LLC

(57) ABSTRACT

An improved wheel rim expanding tooling apparatus includes an inboard and an outboard wheel rim expanding tooling assembly. The inboard wheel rim expanding tooling assembly includes a plurality of segmented inboard press members each including a pair of side surfaces. The side surfaces include a first outer section and a second inner section. The first outer section extends radially inwardly a first radial distance and the second inner section extends radially inwardly a second radial distance which is greater than the first radial distance. The first outer section of the inboard press members is provided with a generally curved surface profile which extends across at least a portion of an axial width thereof. The outboard wheel rim expanding tooling assembly includes a plurality of segmented outboard press members each including a pair of side surfaces. The side surfaces include a first outer section and a second inner section. The first outer section extends radially inwardly a first radial distance and the second inner section extends radially inwardly a second radial distance which is greater than the first radial distance. The first outer section of the outboard press members is provided with a generally curved surface profile which extends across at least a portion of an axial width thereof.

19 Claims, 9 Drawing Sheets

APPARATUS FOR PRODUCING A VEHICLE WHEEL RIM

BACKGROUND OF THE INVENTION

This invention relates in general to vehicle wheels and in particular to an improved method and apparatus for producing a vehicle wheel.

A conventional vehicle wheel is typically of a two-piece construction and includes an inner wheel disc and an outer "full" wheel rim. The wheel disc can be cast, forged, or fabricated from steel, aluminum, or other alloys, and includes an inner annular wheel mounting portion and an outer annular portion. The wheel mounting portion of the wheel disc defines an inboard mounting surface and includes a center pilot or hub hole, and a plurality of lug receiving holes formed therethrough for mounting the vehicle wheel to an axle of the vehicle. The wheel rim is fabricated from steel, aluminum, or other alloys, and includes an inboard tire bead seat retaining flange, an inboard tire bead seat, an axially extending well, an outboard tire bead seat, and an outboard tire bead seat retaining flange. In some instances, a three-piece wheel construction having a mounting cup secured to the wheel disc is used. In both types of constructions, the outer annular portion of the wheel disc is secured to the wheel rim by welding.

A full face vehicle wheel is distinguished from other types of wheels by having a one-piece wheel disc construction. In particular, the full face wheel includes a "full face" wheel disc and a "partial" rim. The full face wheel disc can be cast, forged, or fabricated from steel, aluminum, or other alloys. The full face wheel disc includes an inner annular wheel mounting portion and an outer annular portion which defines at least a portion of an outboard tire bead seat retaining flange of the wheel. The wheel mounting portion defines an inboard mounting surface and includes a center pilot or hub hole, and a plurality of lug receiving holes formed therethrough for mounting the wheel to an axle of the vehicle. The partial wheel rim is fabricated from steel, aluminum, or other alloys, and includes an inboard tire bead seat retaining flange, an inboard tire bead seat, an axially extending well, and an outboard tire bead seat. In some instances, the outboard tire bead seat of the wheel rim and the outer annular portion of the wheel disc cooperate to form the outboard tire bead seat retaining flange of the full face wheel. In both types of constructions, the outboard tire bead seat of the wheel rim is positioned adjacent the outer annular portion of the wheel disc and a weld is applied to join the wheel rim and the wheel disc together.

In the above wheel constructions, the wheel rim of the associated vehicle wheel is typically subjected to a final expanding operation to produce a finished wheel rim having a desired final profile prior to securing the wheel rim to the wheel disc by welding. A typical sequence of steps which can be used to produce a full wheel rim for use in a conventional type of vehicle wheel is disclosed in U.S. Pat. No. 4,185,370 to Evans. As shown in this patent, the method includes the steps of: (a) providing a flat sheet of suitable material, such as aluminum or steel; (b) forming the sheet into a cylindrical hoop or band; (c) flaring the lateral edges of the hoop radially outwardly to produce a rim preform having flanges suitable for positioning on a roll forming machine; (d) subjecting the rim preform to a series of roll forming operations to produce a wheel rim having a predetermined shape; and (e) expanding the wheel rim to a produce a finished wheel rim having a predetermined circumference. A sequence of steps which can be used to produce a partial wheel rim for use in a full face type of vehicle wheel is disclosed in U.S. Pat. No. 5,579,578 to Ashley, Jr.

FIG. 17 illustrates a prior art wheel rim expanding tooling apparatus, indicated generally at 210, which can be used in the step (e) above to expand a wheel rim to a produce a finished wheel rim 280 having a predetermined profile. As shown therein, the prior art wheel rim expanding tooling apparatus 210 includes an inboard wheel rim expanding tooling assembly, indicated generally at 212, and an outboard wheel rim expanding tooling assembly, indicated generally at 214. The inboard wheel rim expanding tooling assembly 212 and the outboard wheel rim expanding tooling assembly 214 are supported in a known manner for selective movement between an open, unexpanded position (not shown) and a closed, expanded position shown in prior art FIG. 17.

The inboard expanding tooling assembly 212 includes a plurality of segmented expanding members which are adapted to engage an inner surface of the wheel rim and expand the wheel rim to a final desired profile. In the illustrated prior art embodiment, the inboard expanding tooling assembly 212 includes twelve segmented tooling members (only three of the segmented tooling members are shown in prior art FIG. 18 and identified as 231–233). Each of the segments 221–223 is generally identical to each other. Thus, for discussion purposes, the discussion with respect to any one of the segments of the inboard expanding tooling assembly 212 will generally apply to all the other segments.

As shown in prior FIGS. 18 and 19, the segment 231 includes an outer surface 231A, an inner surface 231B, two end surfaces 231C and 231D, and two side surfaces (only one side surface illustrated at 231E in FIG. 19). The end surfaces 231C and 231D and the side surfaces 231D are generally flat planar surfaces, with the end surface 231C having an offset provided therein. The segment 232 includes an outer surface 232A, an inner surface 232B, two end surfaces 232C and 232D, and two side surfaces 232E and 232F. The end surfaces 232C and 232D and the side surfaces 232E and 232F are generally flat planar surfaces, with the end surface 232C having an offset provided therein (not shown). The segment 233 is similar in construction to the segments 231 and 232. The outboard expanding tooling press assembly 214 includes a segmented construction (one segment illustrated in prior art FIG. 17 at 272), which is similar to that described and illustrated in connection with the inboard expanding tooling press assembly 212.

SUMMARY OF THE INVENTION

This invention relates an improved wheel rim expanding tooling apparatus for producing a vehicle wheel rim. The wheel rim expanding tooling apparatus includes an inboard and an outboard wheel rim expanding tooling assembly. The inboard wheel rim expanding tooling assembly includes a plurality of segmented inboard press members each including a pair of side surfaces. The side surfaces include a first outer section and a second inner section. The first outer section extends radially inwardly a first radial distance and the second inner section extends radially inwardly a second radial distance which is greater than the first radial distance. The first outer section of the inboard press members is provided with a generally curved surface profile which extends across at least a portion of an axial width thereof. The outboard wheel rim expanding tooling assembly includes a plurality of segmented outboard press members each including a pair of side surfaces. The side surfaces include a first outer section and a second inner section. The first outer section extends radially inwardly a first radial distance and the second inner section extends radially inwardly a second radial distance which is greater than the first radial distance. The first outer section of the outboard press members is provided with a generally curved surface profile which extends across at least a portion of an axial width thereof.

Other advantages of this invention will become apparent to those skilled in the art from the following detailed description of the preferred embodiments, when read in light of the accompanying drawings.

DESCRIPTION OF THE PREFERRED EMBODIMENTS

Figure 1:
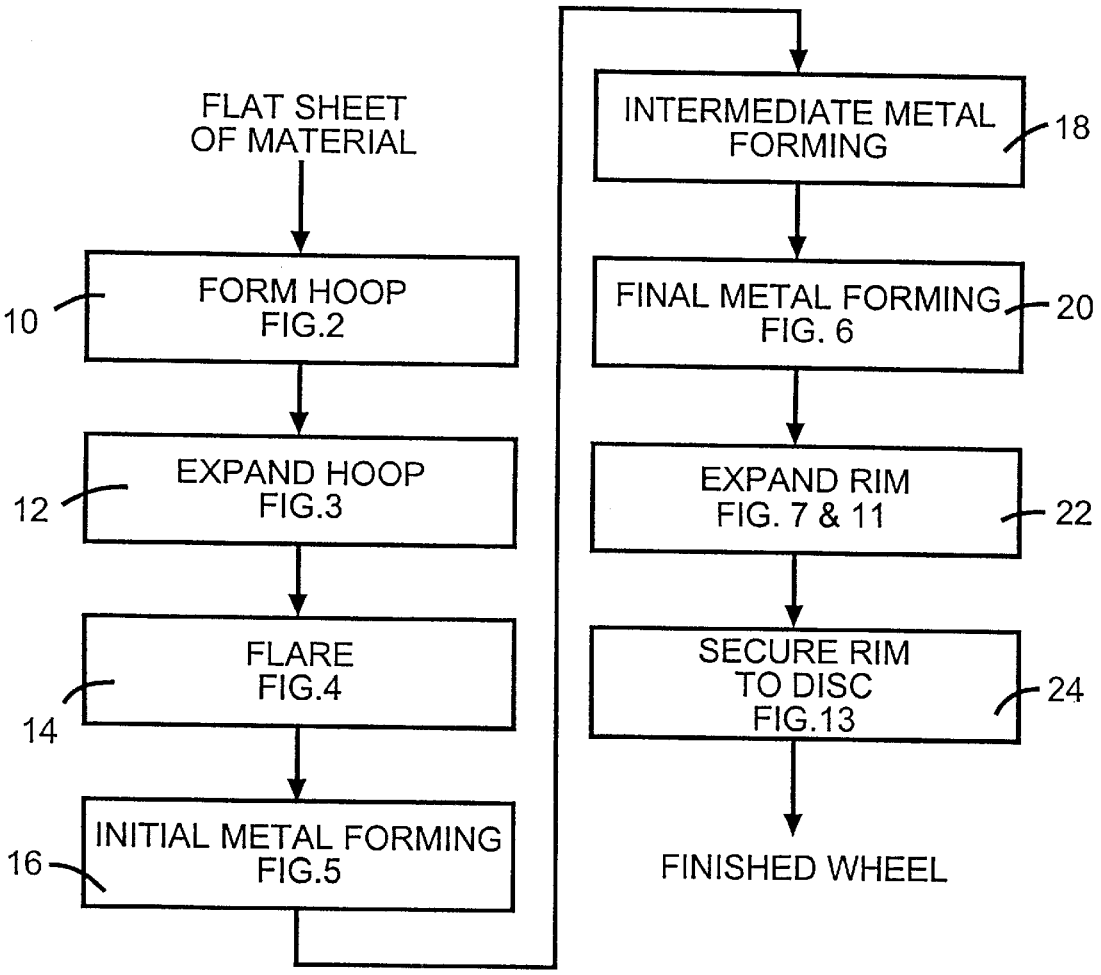
FIG. 1 is a block diagram showing a sequence of steps for producing a wheel rim for use in a vehicle wheel in accordance with the present invention.
Figure 13:
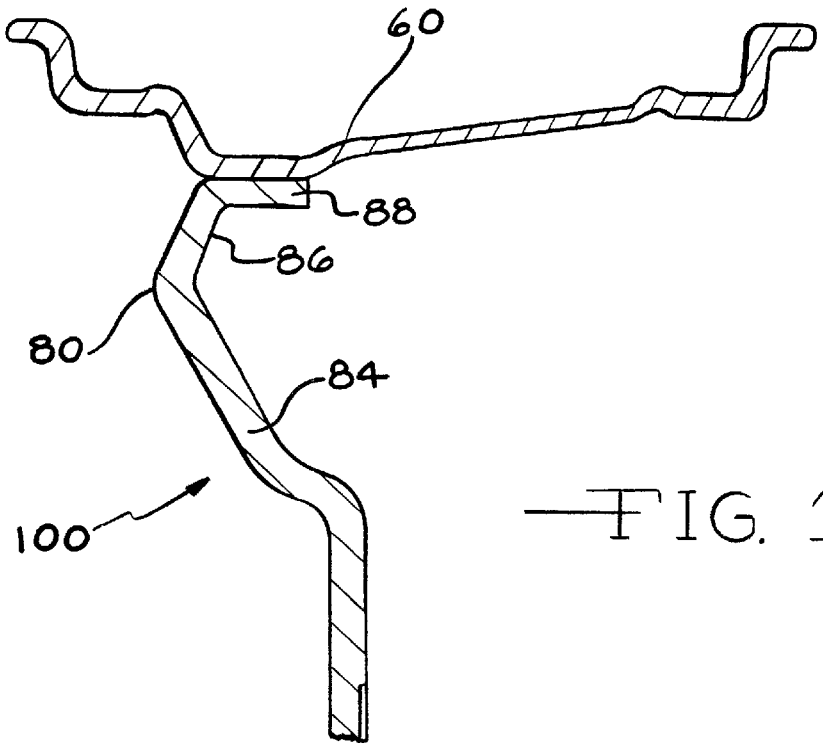
FIG. 13 is a partial sectional view of a first embodiment of a vehicle wheel constructed using a wheel rim produced using the wheel rim expanding tooling apparatus in accordance with the present invention.

Referring now to the drawings, there is illustrated in FIG. 1 a block diagram showing a sequence of steps for producing a first embodiment of a vehicle wheel 100, such as shown in FIG. 13, and which incorporates a first embodiment of a wheel rim, indicated generally at 60, and constructed in accordance with this invention. As shown in this embodiment, the vehicle wheel 100 is a well attached vehicle wheel. While the present invention will be described and illustrated in connection with the particular vehicle wheels disclosed herein, it is understood that the invention can be used to produce a wheel rim for use in constructing other types of vehicle wheels, if so desired.

Figure 2:
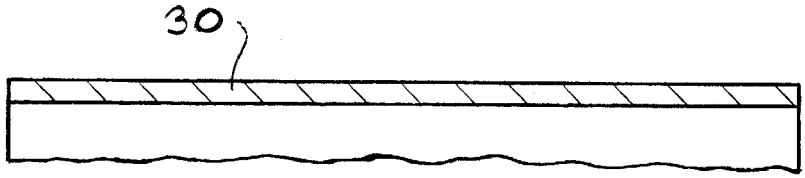
FIG. 2 is a schematic diagram of a wheel rim blank being formed into a hoop.
Figure 3:
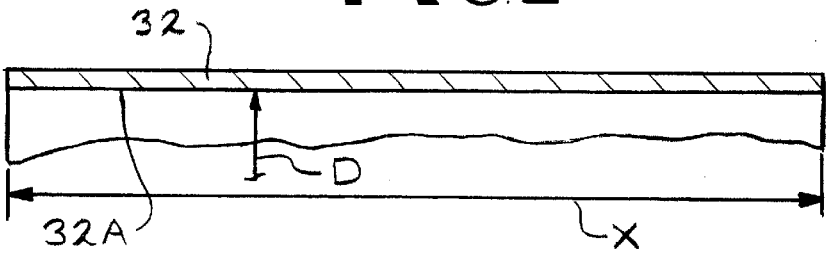
FIG. 3 is a schematic diagram of the hoop after an expanding operation.

Initially in step 10, a flat sheet of suitable material, such as for example, steel, aluminum, or alloys thereof, is formed into a generally cylindrical hoop or band and is welded to produce the hoop 30 shown in FIG. 2. When the hoop 30 is welded in step 10, a flat surface (not shown) is typically created by the weld. As a result of this, the hoop 30 is expanded in step 12 to produce a substantially cylindrical hoop 32 shown in FIG. 3. The hoop 32 extends a predetermined axial length X and includes an inner surface 32A which defines a predetermined inner diameter D thereof.

Figure 4:
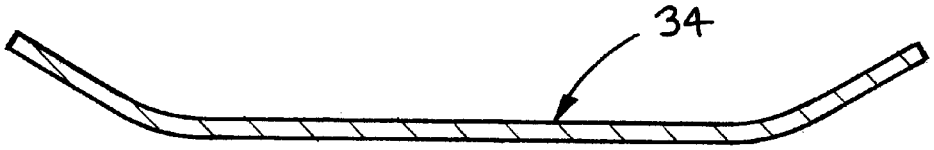
FIG. 4 is a schematic diagram of a wheel rim preform produced by a flaring operation.
Figure 5:
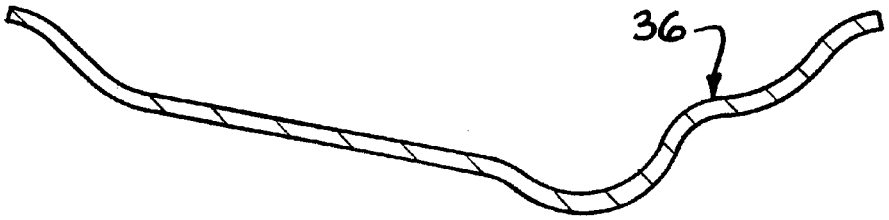
FIG. 5 is a schematic diagram of a partially shaped wheel rim produced by an initial metal forming operation.
Figure 6:
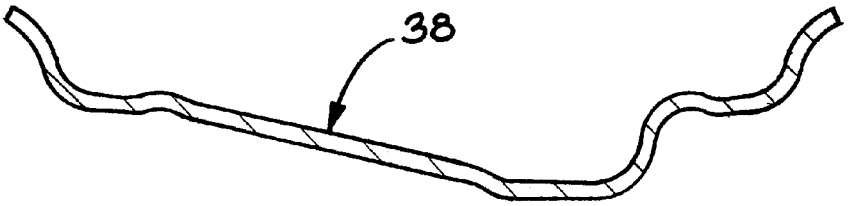
FIG. 6 is a schematic diagram of the partially shaped wheel rim produced by a final metal forming operation.

Next, in step 14, the opposed ends of the hoop 32 are flared upwardly as to produce a wheel rim preform 34 shown in FIG. 4. Following this, in steps 16, 18, and 20, the wheel rim preform 34 is subjected to a series of metal forming operations to progressively produce wheel rims 36 and 38 (initial metal forming step 16 is operative to produce wheel rim 36 as shown in FIG. 5, and final metal forming step 20 which is operative to produce wheel rim 38 as shown in FIG. 6). Preferably, the metal forming operations of steps 16, 18, and 20 include subjecting the wheel rim preform 34 to a series of roll forming operations since tighter tolerances can be maintained in the wheel rim 60. Alternatively, other metal forming operations can be used in one or more of the steps 16, 18, and 20 to progressively produce the wheel rim 60. For example, the wheel rim preform 34 can be subjected to forward or reverse flow spinning operations, pressing operations, or any suitable combinations of roll forming, flow spinning, and pressing operations which are operative to cause deformation, reshaping, and/or thinning of the metal to produce a variable thickness wheel rim having 60 having a desired profile. Also, while three metal forming operations are illustrated by steps 16, 18 and 20, the number of steps can be other than illustrated, if so desired.

Next, in step 22 and referring to FIGS. 8–12, the wheel rim 38 is expanded to produce the finished wheel rim 60 in accordance with the present invention. To accomplish this, the wheel rim 38 is supported in the position shown in FIG. 8 by suitable support means (not shown) to enable the wheel rim 38 to be processed in accordance with a vehicle wheel rim expanding tooling apparatus, indicated generally at 110, of the present invention. The general structure and operation of the wheel rim expanding tooling apparatus 110 is conventional in the art. Thus, only those portions of the wheel rim expanding tooling apparatus 110 which are necessary for a full understanding of this invention will be explained and illustrated in detail.

Figure 8:
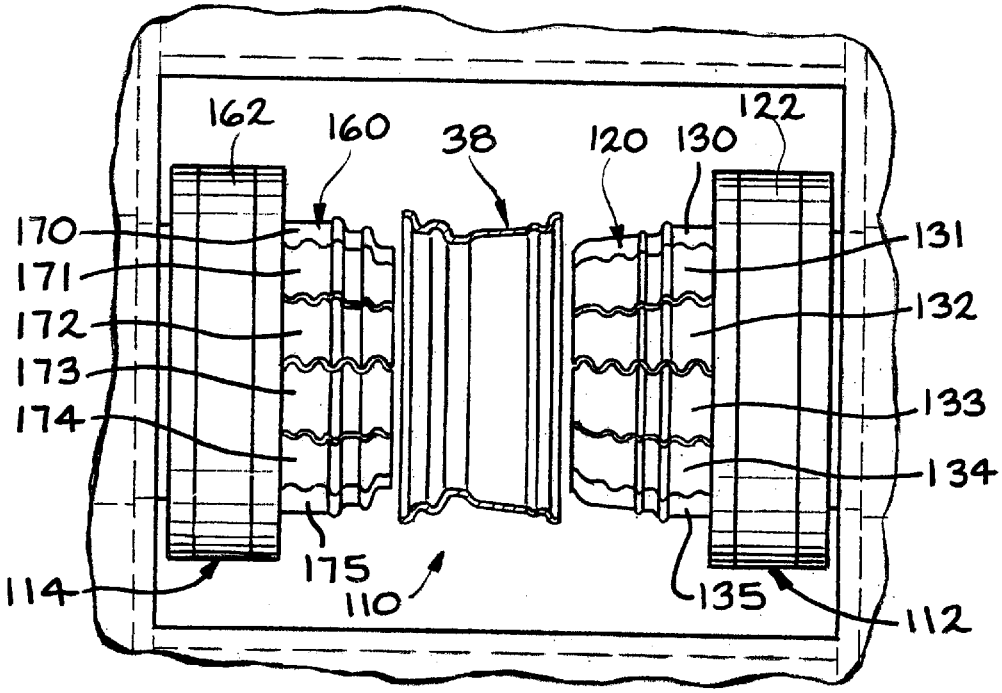
FIG. 8 is an elevational view of the wheel rim expanding tooling apparatus in accordance with the present invention, with the wheel rim expanding tooling apparatus being shown in an open, unexpanded non-working position.

As shown in FIG. 8, the wheel rim expanding tooling apparatus 110 of the present invention includes an inboard wheel rim expanding tooling assembly, indicated generally at 112, and an outboard wheel rim expanding tooling assembly, indicated generally at 114. The inboard wheel rim expanding tooling assembly 112 includes an inboard expander press assembly 120, a barrel head 122, and an inboard expander press guide support assembly (not shown). The barrel head 122 and the inboard expander press guide support assembly are conventional in the art. The inboard expander press guide support assembly is operative to support the inboard expander press assembly 120 for selective movement between the open, unexpanded position shown in FIG. 8 and the closed, expanded position shown in FIG. 9.

Figure 9:
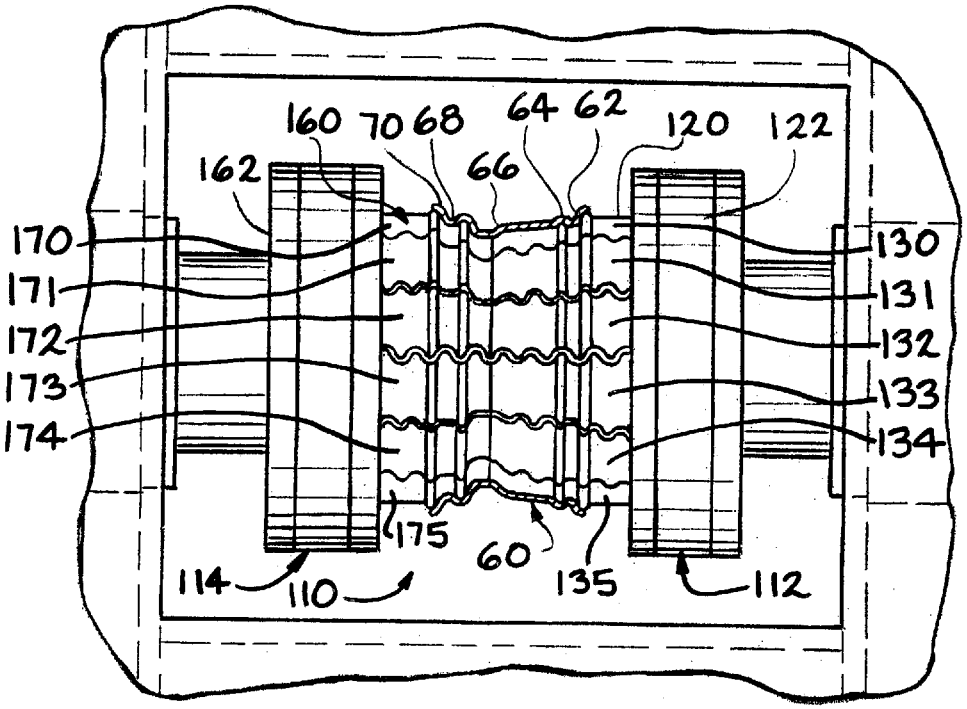
FIG. 9 is an elevational view similar to FIG. 8 and showing the wheel rim expanding tooling apparatus in a closed, fully expanded position.

In accordance with the present invention, the inboard expander press assembly 120 includes a plurality of segmented press members which are adapted to engage an inner surface of the associated vehicle wheel rim 38 and expand the wheel rim 38 to a desired final profile during step 22. In the illustrated embodiment, the inboard expander press assembly 120 includes twelve segmented press members (only six of the segmented press members are shown in FIGS. 8 and 9 and identified as 130, 131, 132, 133, 134 and 135). Each of the segments 130–135 are generally identical to each other. Thus, for discussion purposes, the discussion with respect to any one of the segments of the inboard expander press 120 will generally apply to all the other segments. Alternatively, one or more of the segments of the inboard press assembly 120 can not be identical to the others, if so desired.

Figure 10:
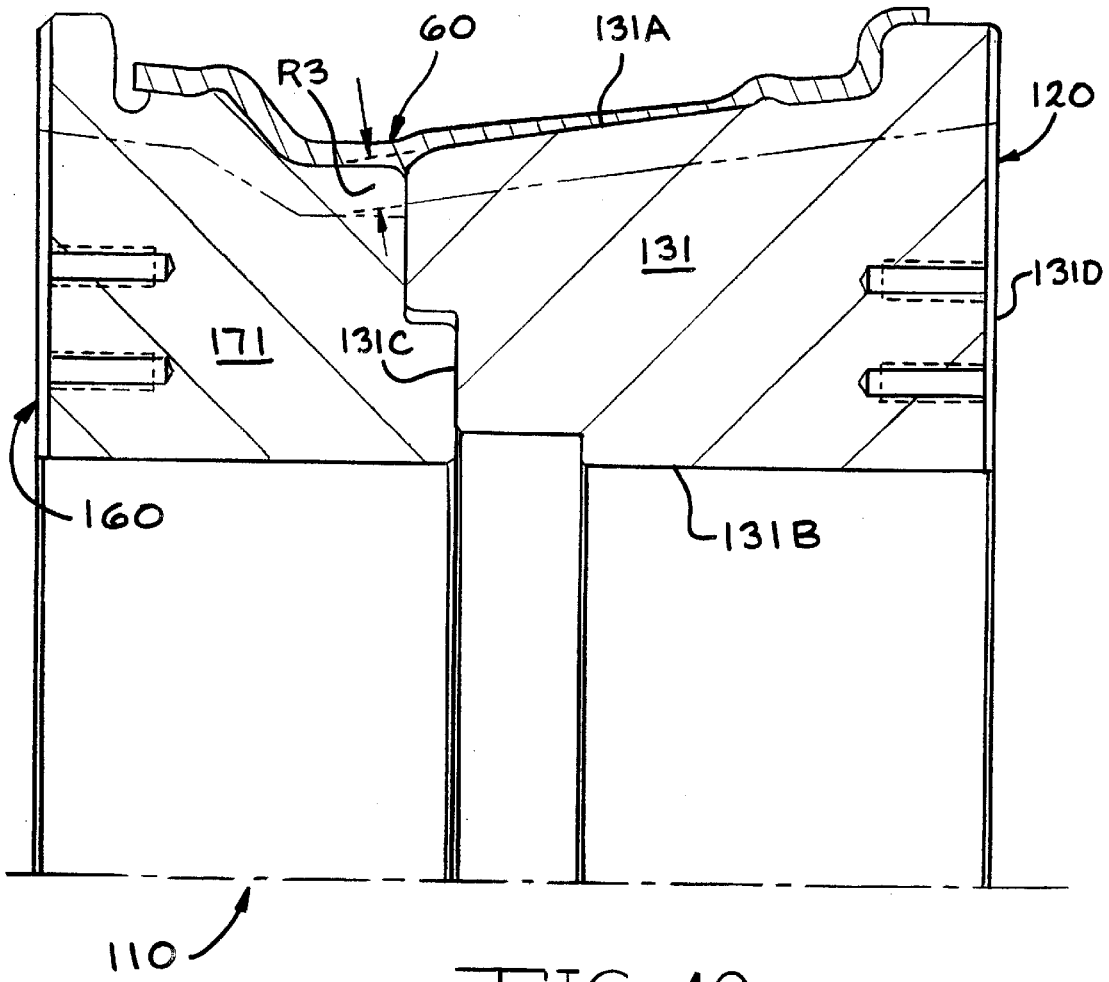
FIG. 10 is a partial elevational view of a portion of the wheel rim expanding tooling apparatus illustrated in FIG. 9, with the wheel rim expanding tooling apparatus being shown in the closed, fully expanded position.
Figure 11:
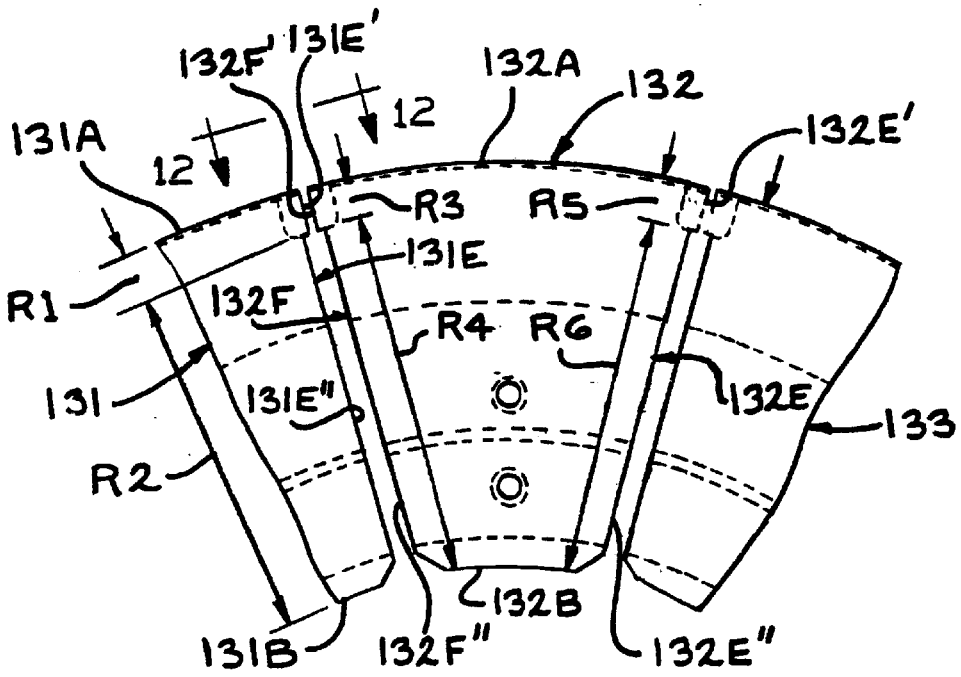
FIG. 11 is a partial sectional view of a portion of the wheel rim expanding tooling apparatus of the present invention.

Turning now to FIG. 11, there is illustrated a portion of the inboard expander press assembly 120 showing three segments 131, 132 and 133 thereof. As shown therein, the segment 131 includes an outer surface 131A, an inner surface 131B, two end surfaces 131C and 131D, and two side surfaces (only one such side surface illustrated at 131E). The end surface 131C is a generally flat planar surface with an offset provided therein (shown in FIG. 10), and the end surface 131D is a generally flat planar surface.

The side surface 131E includes a first or outer section 131E' which extends radially inwardly a first distance R1 relative to the outer surface 131A along a substantial portion thereof, and a second or inner section 131E" which extends radially inwardly a second distance R2. Preferably, as illustrated, the first radial distance R1 is less than second radial distance R2. The first section 131E' includes a wavy or curved surface profile, and the second section 131E" includes a generally flat planar surface profile. In the illustrated embodiment, the first section 131E' profile is of a generally serpentine shape. Preferably, the curved surface profile of the first section 131E' extends across the entire axial width W1 of the segment, and the first radial distance R1 is about 0.5 inches for a purpose to be discussed below. Alternatively, the curved surface profile of the first section 131E' can extend across less than the entire axial width W1 of the segment 131 if so desired; the profile of the first section 131E' and/or the second section 131E" can be other than illustrated if so desired; the radial distance R1 can be equal to or greater than the radial distance R2 if so desired; and the distance R1 can be less than 0.5 inches or greater than 0.5 inches if so desired. Also, the side surface 131E could include a curved surface profile along the entire surface thereof extending from the outer surface 131A to the inner surface 131B.

The segment 132 includes an outer surface 132A, an inner surface 132B, two end surfaces 132C and 132D, and two side surfaces 132E and 131F. The end surface 132C is a generally flat planar surface with an offset (not shown) provided therein, and the end surface 132D is a generally flat planar surface.

Figure 12:
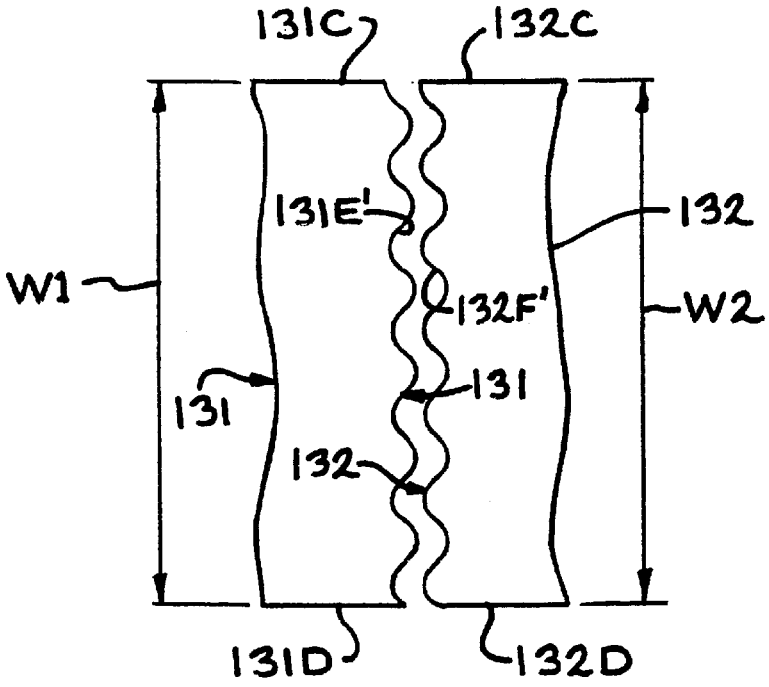
FIG. 12 is a partial view taken along line 12—12 of FIG. 11.

The side surface 132F includes a first or outer section 132F' which extends radially inwardly a first distance R3 relative to the outer surface 132A along a substantial portion thereof, and a second or inner section 132F" which extends radially inwardly a second distance R4. Preferably, as illustrated, the first distance R3 is less than second distance R4. The first section 132F' includes a wavy or curved surface profile, and the second section 132F" includes a generally flat planar surface profile. In the illustrated embodiment, the first section 132F' profile is of a generally serpentine shape. Preferably, the curved surface profile of the first section 132F' extends across the entire axial width W2 of the segment 132, and the first distance R3 is about 0.5 inches for a purpose to be discussed below. Alternatively, the curved surface profile of the first section 132F' can extend across less than the entire axial width W2 of the segment 132 if so desired; the profile of the first section 132F' and/or the second section 132F" can be other than illustrated if so desired; the radial distance R3 an be equal to or greater than the radial distance R4 if so desired; and the distance R3 can be less than 0.5 inches or greater than 0.5 inches if so desired. Also, the side surface 132F could include a curved surface profile along the entire surface thereof extending from the outer surface 132A to the inner surface 132B. As best shown in FIG. 12, the profile of the first section 131E' of the segment 131 and the profile of the first section 132F' of the segment 132F are preferably complimentary to each other.

The side surface 132E includes a first or outer section 132E' which extends radially inwardly a first distance R5 relative to the outer surface 132A along a substantial portion thereof, and a second or inner section 132E" which extends radially inwardly a second distance R6. Preferably, as illustrated, the first distance R5 is less than second distance R6. The first section 132E' includes a wavy or curved surface profile, and the second section 132E" includes a generally flat planar surface profile. In the illustrated embodiment, the first section 132E' profile is of a generally serpentine shape. Preferably, the first distance R5 is about 0.5 inches for a purpose to be discussed below.

As discussed above, the curved surface profile of the first section 131E' preferably extends from the outer surface 131A radially inwardly a first distance R1 which is about 0.5 inches. As a result of this, the outer surface 131A of the segment 131, as well as the associated outer surface of all of the other respective segments, can be refinished a number of times to return the surface to a desired generally annular outer surface profile to accommodate for wear thereof during the expanding step. Alternatively, the profile of the first section 131E' and/or the second section 131E" can be other than illustrated if so desired. Also, as discussed above, the side surface 131E of the segment 131 (as well as the associated side surfaces of all of the other respective segments), could include a curved surface profile along the entire surface thereof extending from the outer surface 131A to the inner surface 131B thereof.

The outboard wheel rim expanding tooling assembly 114 includes an outboard expander press assembly 160, a barrel head 162, and an outboard expander press guide support assembly (not shown). The barrel head 162 and the inboard expander press guide support assembly are conventional in the art. The outboard expander press guide support assembly is operative to support the outboard expander press assembly 160 for selective movement between the position shown in FIG. 8 and the position shown in FIG. 9.

The outboard expander press assembly 160 includes a plurality of segmented press members which are adapted to engage the inner surface of the vehicle wheel rim 38 and expand the wheel rim 38 to a desired final profile during step 22. In the illustrated embodiment, the outboard expander press assembly 160 includes twelve segmented press members (only six of the segmented press members are shown in FIGS. 8 and 9 and identified as 170, 171, 172, 173, 174 and 175). Each of the segments 170–175 are generally identical to each other. The construction of the segments of the outboard expander press assembly 160 is generally similar to that of the segments of the inboard expander press assembly 120 in that each segment includes a respective curved side surface which extends radially inwardly a selected distance relative to an associated outer surface along a substantial portion thereof.

In accordance with the present invention, the outboard expander press assembly 160 includes a plurality of segmented press members which are adapted to engage an inner surface of the associated wheel rim 38 and expand the wheel rim 38 to a final desired profile during step 22. In the illustrated embodiment, the outboard expander press assembly 126 includes twelve segmented press members (only six of the segmented press members are shown in FIGS. 8 and 9 and identified as 170, 171, 172, 173, 174 and 175). Each of the segments 170–175 are generally identical to each other. Also, each of the segments of the outboard expander press assembly 160 includes a curved outer surface profile which is similar to that discussed above and shown in FIGS. 10–12 with respect to the segments of the inboard expander press 120.

Figure 7:
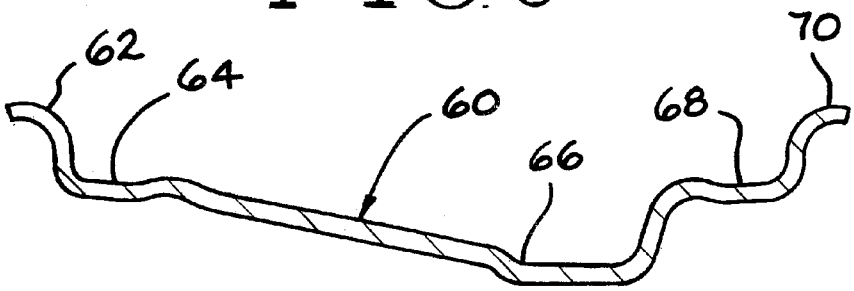
FIG. 7 is a schematic diagram of the finished wheel rim produced by an expanding operation.

As shown in FIGS. 7 and 10, the "expanded" finished wheel rim 60 includes an inboard tire bead seat retaining flange 62, an inboard tire bead seat 64, a generally axially extending well 66, and an outboard tire bead seat 68, and an outboard tire bead seat retaining flange 70. In step 24, the wheel rim 60 is secured to a preformed wheel disc, indicated generally at 80 in FIG. 13, by welding to produce the finished vehicle wheel 100. As shown in FIG. 13, the wheel disc 80 includes a central mounting portion 82, an intermediate bowl-shaped portion 84, and an outer portion 86 which includes a flange 88. The wheel disc 80 can be formed from steel, aluminum, or alloys thereof depending upon the construction of the associated wheel rim 60.

Figure 14:
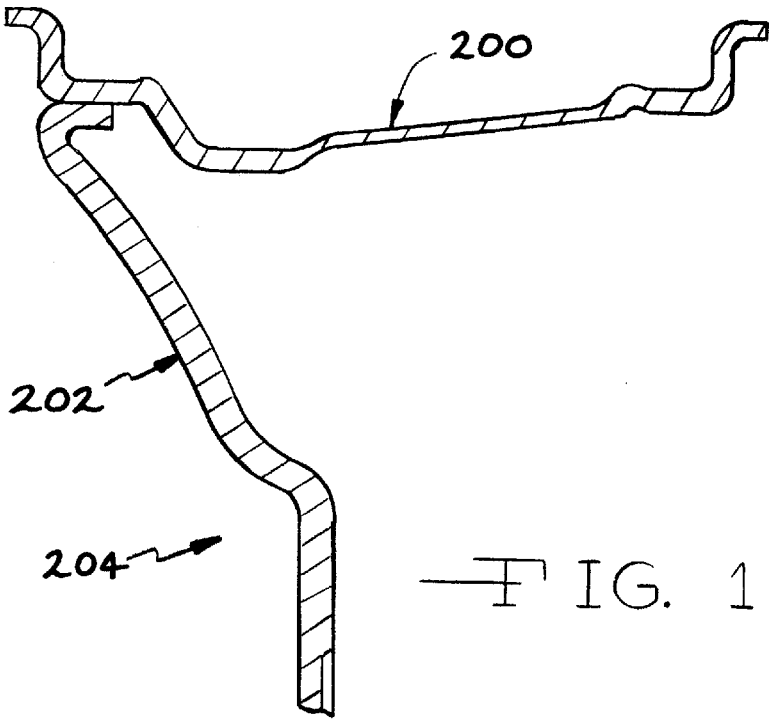
FIG. 14 is a partial sectional view of a second embodiment of a vehicle wheel produced using a wheel rim produced using the wheel rim expanding tooling apparatus in accordance with the present invention.
Figure 15:
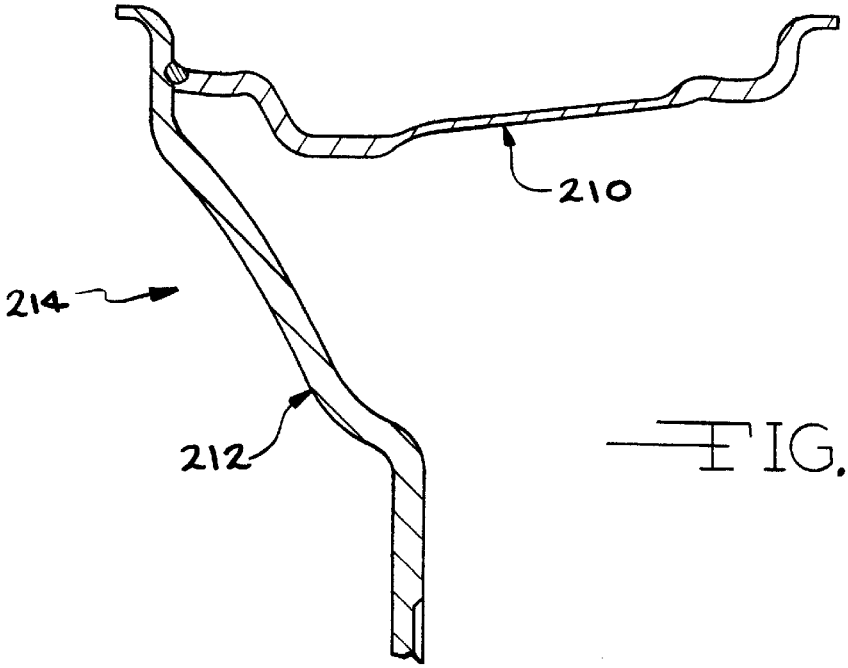
FIG. 15 is a partial sectional view of a third embodiment of a vehicle wheel produced using a wheel rim produced using the wheel rim expanding tooling apparatus in accordance with the present invention.
Figure 16:
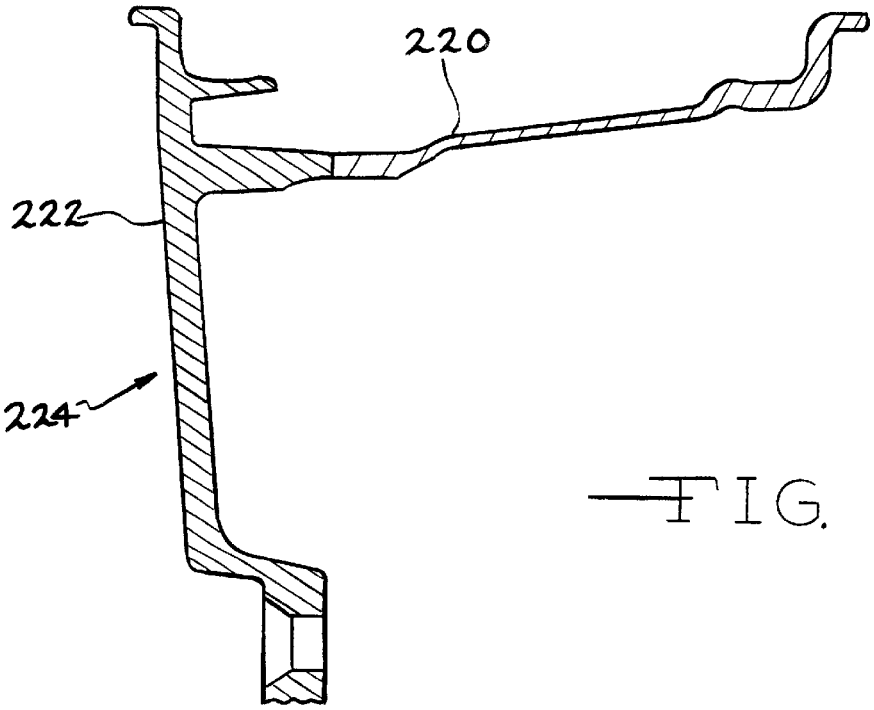
FIG. 16 is a partial sectional view of a fourth embodiment of a vehicle wheel produced using a wheel rim produced using the wheel rim expanding tooling apparatus in accordance with the present invention.
Figure 17:
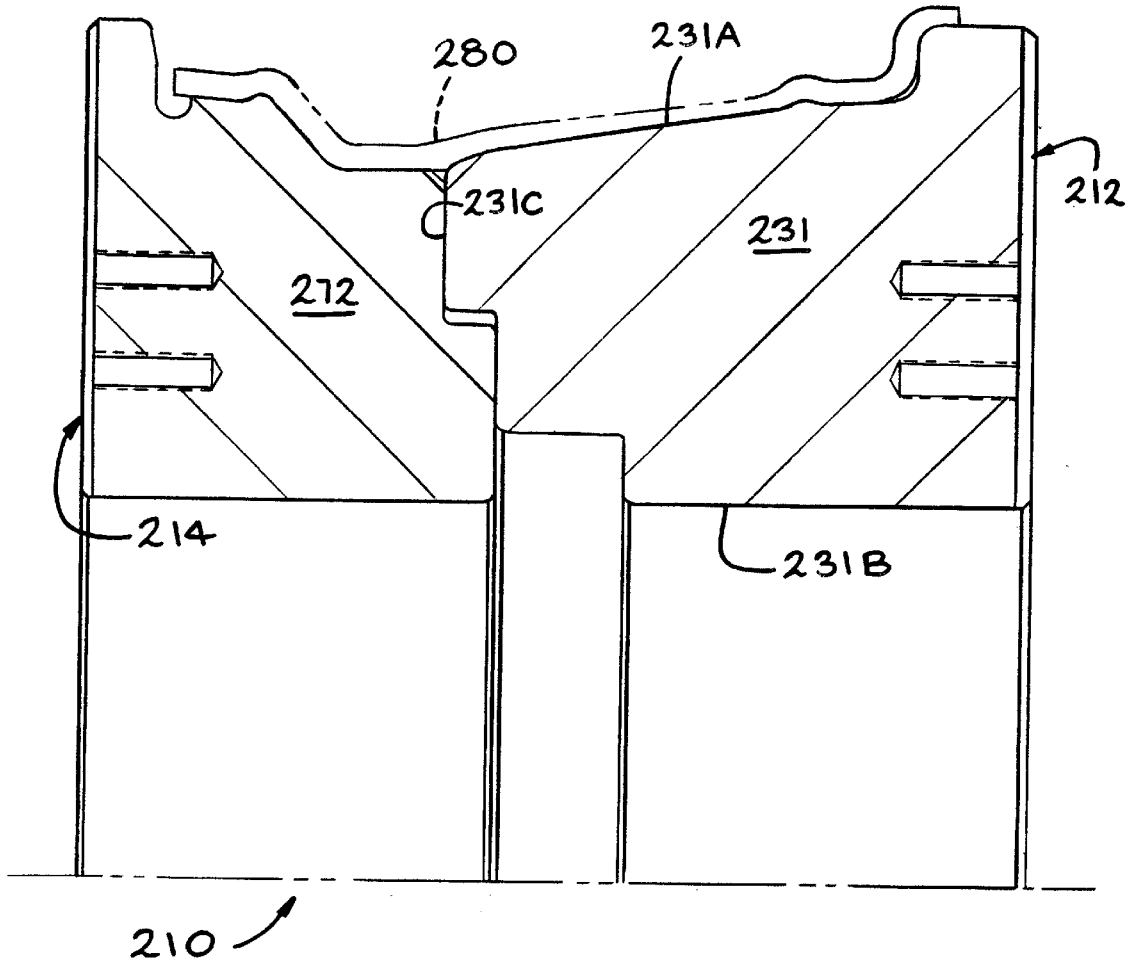
FIG. 17 PRIOR ART
FIG. 17 is a partial elevational view of a portion of a prior art wheel rim expanding tooling apparatus, with the prior art wheel rim expanding tooling apparatus being shown in the closed, fully expanded position.
Figure 18:
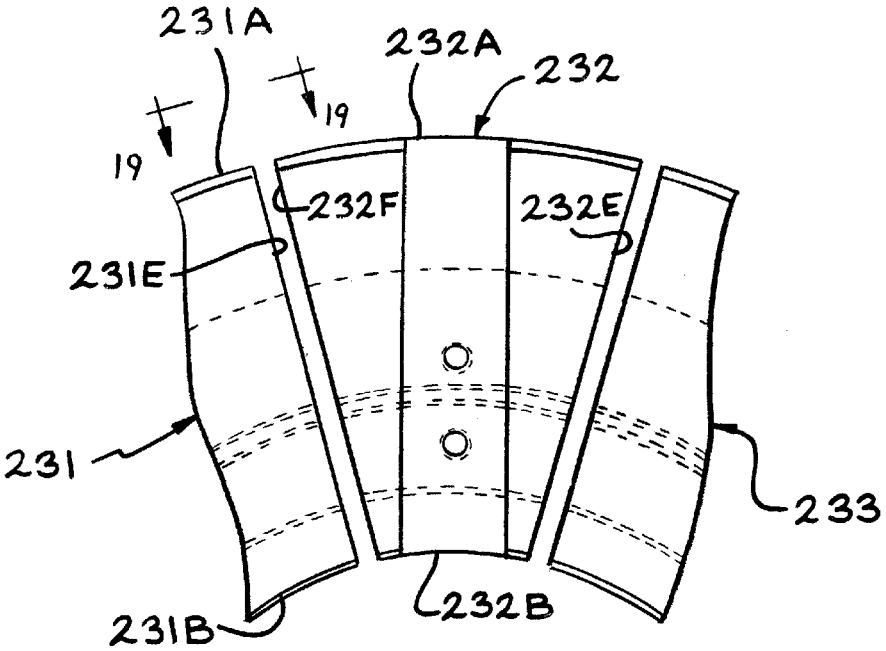
FIG. 18 PRIOR ART
FIG. 18 is a partial sectional view of a portion of the prior art wheel rim expanding tooling apparatus shown in FIG. 17.
Figure 19:
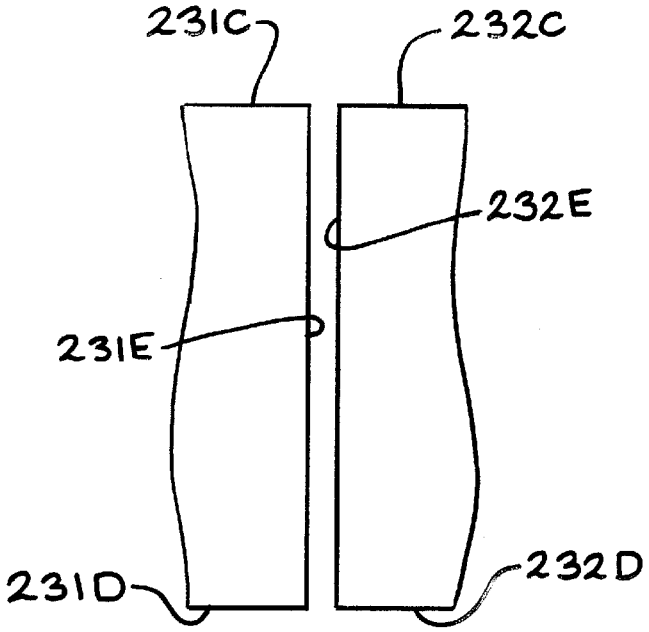
FIG. 19 PRIOR ART
FIG. 19 is a partial view taken along line 19—19 of FIG. 18.

While the invention has been illustrated and described as forming a wheel rim 60 for use in a bead seat attached vehicle wheel 100, the invention can be practiced to form an associated wheel rim for use in other types of wheels. For example, as shown in FIG. 14, the invention can be practiced to produce a wheel rim 200 which is secured to a preformed wheel disc 202 to produce a "bead seat" attached vehicle wheel 204. Also, as shown in FIG. 15, the invention can be practiced to produce a "partial" wheel rim 210 which is secured to a "full face" wheel disc 212 to produce a full face vehicle wheel 214. In addition, as shown in FIG. 16, the invention can be practiced to produce a "partial" wheel rim 220 which is secured to a full face wheel disc 222 to produce a full face modular vehicle wheel 224.

One advantage of the present invention is that curved outer side surfaces of the segments of both the inboard wheel rim expanding tooling assembly 120 and the outboard wheel rim expanding tooling assembly 160 of the wheel rim expanding tooling apparatus 100 are operative to define an "interlaced" construction wherein the associated edges thereof are effective to cooperate to better support the vehicle wheel rim during the expanding process. As a result, necking or thinning of the wheel rim material between the associated segments of the inboard wheel rim expanding tooling assembly 120 and the outboard wheel rim expanding tooling assembly 160 is reduced during the expanding process thereby reducing scrap. Also, the curved outer side surfaces of the segments of the inboard wheel rim expanding tooling assembly 120 and the outboard wheel rim expanding tooling assembly 160 are effective to improve the roundness of the resulting wheel rim 60 compared to the roundness of the wheel rim 280 produced by the prior art wheel rim expanding tooling apparatus 210.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A wheel rim expanding tooling apparatus comprising:

an inboard wheel rim expanding tooling assembly including a plurality of segmented press members, each of said segmented press members including an outer surface, an inner surface, and at least one side surface, said at least one side surface of at least one of said segmented press members including a section which extends radially inwardly relative to said outer surface, said section provided with a generally curved surface profile which extends across at least a portion of an axial width thereof; and an outboard wheel rim expanding tooling assembly including a plurality of segmented press members;

wherein said section of said side surface is a first outer section, said section further including a second inner section provided with a generally flat surface profile, wherein said curved surface profile extends a first radial distance, said flat surface profile extends a second radial distance which is greater than said first radial distance.

2. The wheel rim expanding tooling apparatus according to claim 1 wherein said curved surface profile extends across the entire axial width of said section.

3. The wheel rim expanding tooling apparatus according to claim 1 wherein each of said segmented press members includes a pair of side surfaces each having a section which extends radially inwardly relative to an associated outer surface thereof, each of said pair of side surfaces of said sections provided with a generally curved surface profile which extends across at least a portion of an axial width thereof.

4. The wheel rim expanding tooling apparatus according to claim 3 wherein said curved surface profile of said side surface of each pair of adjacent sections are generally complimentary to each other.

5. The wheel rim expanding tooling apparatus according to claim 1 wherein said curved surface profile is generally serpentine shaped.

6. The wheel rim expanding tooling apparatus according to claim 1 wherein each of said segmented press members of said outboard wheel rim expanding tooling assembly includes an outer surface, an inner surface, and at least one side surface, said at least one side surface of at least one of said segmented press members including a section which extends radially inwardly relative to said outer surface, said section provided with a generally curved surface profile which extends across at least a portion of an axial width thereof.

7. The wheel rim expanding tooling apparatus according to claim 6 wherein said curved surface profile extends across the entire axial width of said section of said segmented press member of said outboard wheel rim expanding tooling assembly.

8. A wheel rim expanding tooling apparatus according to claim 6 wherein each of said segmented press members of said outboard wheel rim expanding tooling assembly includes a pair of side surfaces each having a section which extends radially inwardly relative to an associated outer surface thereof, each of said side surfaces of said sections provided with a generally curved surface profile which extends across at least a portion of an axial width thereof.

9. A wheel rim expanding tooling apparatus according to claim 8 wherein said curved surface profile of said side surfaces of each pair of adjacent sections of said segmented press members of said outboard wheel rim expanding tooling assembly are generally complimentary to each other.

10. A wheel rim expanding tooling apparatus according to claim 6 wherein said curved surface profile of said section of said segmented press member of said outboard wheel rim expanding tooling assembly is generally serpentine shaped.

11. A wheel rim expanding tooling apparatus adapted to engage an inner surface of a vehicle wheel to expand the wheel rim to a desired final profile comprising:

inboard wheel rim expanding tooling assembly including a plurality of segmented inboard press members adapted to engage the inner surface of the vehicle wheel rim to expand the wheel rim to a desired final profile, each of said segmented inboard press members including an outer surface, an inner surface, a pair of end surfaces, and a pair of side surfaces, each of said side surfaces of said segmented inboard press members including a first outer section and a second inner section, said first outer section extending radially inwardly relative to said outer surface a first radial distance and said second inner section extending radially inwardly relative to said first section a second radial distance which is greater than said first radial distance, said first outer section provided with a generally curved surface profile which extends across at least a portion of an axial width thereof, said second inner section provided with a generally flat surface profile; and an outboard wheel rim expanding tooling assembly including a plurality of segmented outboard press members adapted to engage the inner surface of the vehicle wheel rim to expand the wheel rim to a desired final profile, each of said segmented outboard press members including an outer surface, an inner surface, a pair of end surfaces, and a pair of side surfaces, each of said side surfaces of said segmented outboard press members including a first outer section and a second inner section, said first outer section extending radially inwardly relative to said outer surface a first radial distance and said second inner section extending radially inwardly relative to said first section a second radial distance which is greater than said first radial distance, said first outer section provided with a generally curved surface profile which extends across at least a portion of an axial width thereof, said second inner section provided with a generally flat surface profile.

12. The wheel rim expanding tooling apparatus according to claim 11 wherein said curved surface profile of said first outer sections of said side surfaces of said segmented outboard and inboard press members extends across the entire axial width thereof.

13. The wheel rim expanding tooling apparatus according to claim 11 wherein said curved surface profile of said side surface of each pair of adjacent sections of said first outer sections of said side surfaces of said segmented outboard and inboard press members are generally complimentary to each other.

14. The wheel rim expanding tooling apparatus according to claim 11 wherein said curved surface profile is generally serpentine shaped.

15. A wheel rim expanding tooling apparatus comprising:

an outboard wheel rim expanding tooling assembly including a plurality of segmented press members, each of said segmented press members including an outer surface, an inner surface, and at least one side surface, said at least one side surface of at least one of said segmented press members including a section which extends radially inwardly relative to said outer surface, said section provided with a generally curved surface profile which extends across at least a portion of an axial width thereof; and an inboard wheel rim expanding tooling assembly including a plurality of segmented press members;

wherein said section of said side surface is a first outer section, said section further including a second inner section provided with a generally flat surface profile, wherein said curved surface profile extends a first radial distance, said flat surface profile extends a second radial distance which is greater than said first radial distance.

16. The wheel rim expanding tooling apparatus according to claim 15 wherein said curved surface profile extends across the entire axial width of said section.

17. The wheel rim expanding tooling apparatus according to claim 15 wherein each of said segmented press members includes a pair of side surfaces each having a section which extends radially inwardly relative to an associated outer surface thereof, each of said pair of side surfaces of said sections provided with a generally curved surface profile which extends across at least a portion of an axial width thereof.

18. The wheel rim expanding tooling apparatus according to claim 17 wherein said curved surface profile of said side surface of each pair of adjacent sections are generally complimentary to each other.

19. The wheel rim expanding tooling apparatus according to claim 15 wherein said curved surface profile is generally serpentine shaped.

* * * * *